US007135433B2

(12) United States Patent
Foster et al.

(10) Patent No.: US 7,135,433 B2
(45) **Date of Patent: *Nov. 14, 2006**

(54) THERMAL PRINT ASSEMBLY

(75) Inventors: David G. Foster, West Henrietta, NY (US); Teh-Ming Kung, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 85 days.

This patent is subject to a terminal disclaimer.

(21) Appl. No.: 10/729,215

(22) Filed: Dec. 5, 2003

(65) Prior Publication Data

US 2005/0059551 A1 Mar. 17, 2005

(51) Int. Cl.
*B41M 5/035* (2006.01)
*B41M 5/38* (2006.01)

(52) U.S. Cl. ..... 503/227

(58) Field of Classification Search ..... 428/32–39, 428/32.5, 32.51, 32.52; 503/227
See application file for complete search history.

(56) References Cited

U.S. PATENT DOCUMENTS

| | | | |
|---|---|---|---|
| 4,626,256 | A | 12/1986 | Kawasaki et al. |
| 4,643,917 | A | 2/1987 | Koshizuka et al. |
| 4,740,496 | A | 4/1988 | Vanier |
| 4,820,687 | A | 4/1989 | Kawasaki et al. |
| 4,839,338 | A | 6/1989 | Marbrow |
| 4,927,666 | A | 5/1990 | Kawasaki et al. |
| 4,968,659 | A | 11/1990 | Nishitani |
| 5,118,657 | A | 6/1992 | Kawakami et al. |
| 5,300,476 | A | 4/1994 | Kubodera et al. |
| 5,356,859 | A | 10/1994 | Lum et al. |
| 5,466,657 | A | 11/1995 | Egashira et al. |
| 5,674,804 | A | 10/1997 | Steen et al. |
| 5,763,358 | A | 6/1998 | Kaszczuk et al. |

FOREIGN PATENT DOCUMENTS

| | | |
|---|---|---|
| EP | 0390044 B1 | 10/1993 |
| EP | 0718117 A1 | 6/1996 |
| JP | 60129295 | 7/1985 |
| JP | 61262189 | 5/1988 |
| JP | 63194983 | 8/1988 |
| JP | 1990-196692 | 8/1990 |
| JP | 02220887 | 9/1990 |
| JP | 1991-75191 | 3/1991 |
| JP | 1991-86588 | 4/1991 |
| JP | 1991-178485 | 8/1991 |
| JP | 1991-266692 | 11/1991 |
| JP | 1992-112085 | 4/1992 |
| JP | 1992-163092 | 6/1992 |
| JP | 1992-255394 | 9/1992 |
| JP | 09202058 | 8/1997 |
| JP | 09202059 | 8/1997 |
| JP | 11105442 | 4/1999 |

*Primary Examiner*—Bruce H. Hess
(74) *Attorney, Agent, or Firm*—Kathleen Newner Manne; Lynne M. Blank

(57) ABSTRACT

A print assembly is described, wherein the print assembly includes a dye-donor element having a dye-donor layer, wherein the dye-donor element includes a donor stick preventative agent; and a receiver having a dye image-receiving layer, wherein the receiver includes a receiver stick preventative agent of the formula:

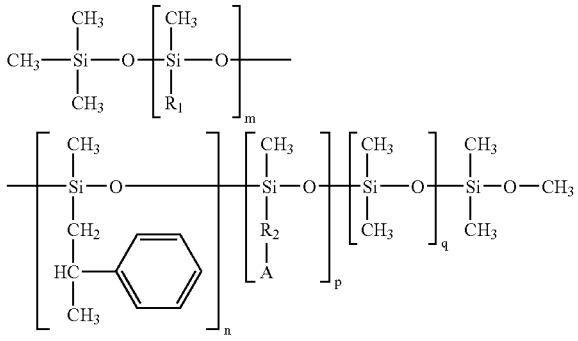

wherein $R_1$ is an alkyl chain of $C_9H_{19}$ or greater; $R_2$ is an alkyl chain of $C_3H_6$ or greater; A is NH—$R_3$, $NHNH_2$, NHCO—$R_3$, NH—$R_4$—$NH_2$, or NHCO—$R_4$—$NH_2$; $R_3$ is alkyl chain of $C_2H_5$ or greater; $R_4$ is an alkyl chain of $C_2H_4$ or greater; m is from about 0 to 95 weight percent; n is from about 0 to about 70 weight percent; p is from 0 to about 40 weight percent; and q is from 0 to 95 weight percent, with the proviso that when m is 0, then n is 0, and $R_3$ is an alkyl chain of $C_8H_{17}$ or greater, otherwise when m is greater than 0, n is from 0.1 to 70 weight percent, based on the total weight of the receiver stick preventative agent, and wherein the dye-donor element and receiver are in superposed position such that the dye-donor layer is adjacent the dye image-receiving layer. The use of stick preventative agents in both the dye-donor element and the receiver element can enable high speed printing without donor-receiver sticking.

39 Claims, No Drawings

THERMAL PRINT ASSEMBLY

CROSS REFERENCE TO RELATED APPLICATIONS

Reference is made to commonly assigned co-pending U.S. patent application Ser. No. 10/667,065 for "Thermal Donor for High Speed Printing," to David G. Foster, et al., and commonly assigned co-pending U.S. patent application Ser. No. 10/664,684 entitled "Thermal Receiver," and its continuation-in-part application, U.S. patent application Ser. No. 110/729,567, both to Teh-Ming Kung, et al.

FIELD OF THE INVENTION

A thermal print assembly having reduced donor-receiver sticking, and a method of printing using the print assembly, are described.

BACKGROUND OF THE INVENTION

Thermal transfer systems have been developed to obtain prints from pictures that have been generated electronically, for example, from a color video camera or digital camera. An electronic picture can be subjected to color separation by color filters. The respective color-separated images can be converted into electrical signals. These signals can be operated on to produce cyan, magenta, and yellow electrical signals. These signals can be transmitted to a thermal printer. To obtain a print, a black, cyan, magenta, or yellow dye-donor layer, for example, can be placed face-to-face with a dye image-receiving layer of a receiver element to form a print assembly which can be inserted between a thermal print head and a platen roller. A thermal print head can be used to apply heat from the back of the dye-donor sheet. The thermal print head can be heated up sequentially in response to the black, cyan, magenta, or yellow signals. The process can be repeated as needed to print all colors. A color hard copy corresponding to the original picture can be obtained. Further details of this process and an apparatus for carrying it out are contained in U.S. Pat. No. 4,621,271 to Brownstein.

A problem exists with many of the dye-donor elements and receiver elements used in thermal dye transfer systems. At the high temperatures used for thermal dye transfer, many polymers used in these elements can soften and adhere to each other, resulting in sticking and tearing of the elements upon separation. Areas of the dye-donor layer (other than the transferred dye) can adhere to the dye image-receiving layer, rendering the receiver element useless. This is especially a problem for high-speed printing, wherein the printing technique can result in higher temperatures in order to transfer suitable amounts of dye.

To reduce donor-receiver sticking, it is known to add release agents to the dye-donor element or the receiver element. Use of silicone waxes and oils as lubricating elements are known in the art. For example, JP 04-255394 is directed to a recording method for "high-speed" printing wherein the coloring material layer of the transfer body and/or the image-receiving layer of the image-receiving body contains a siloxane-containing moisture-curing resin. However, moisture-curing resins can crosslink within the image-receiving layer, reducing dye diffusion and dye stability; can reduce coating uniformity; and can require additional processing steps during manufacture.

JP 02-196692 is directed to a thermal transfer sheet capable of forming a high-density image at "high-speed," wherein a silicone resin is added to a dye layer in an amount of 1–20 parts by weight per 100 parts by weight of a dye-forming resin. U.S. Pat. No. 4,740,496 to Vanier discloses the use of various release agents in a dye layer of a dye-donor element, including various siloxanes. U.S. Pat. No. 5,356,859 to Lum et al. discloses the use of a dye image-receiving element including a polyoxyalkylene-modified dimethylsiloxane graft copolymer. However, the use of such material in extrusion coated receiver elements is difficult because these materials degrade at high temperatures, resulting in unwanted reactions with other components of the receiver element. U.S. Pat. No. 4,839,338 to Marbrow discloses use of a receiver element coated with a release medium including two polysiloxanes that exhibit the same degradation and unwanted reactions as the materials in Lum. U.S. Pat. No. 4,643,917 to Koshizuka describes silicone waxes for use in heat-sensitive transfer recording media, but does not achieve good quality images. JP 61-262189 discloses the use of polyoxyalkylene silicone copolymers as a release material for use in heat sensitive recording materials, particularly where the polyoxyalkylene is grafted into the polysiloxane backbone for use in very high power printers. Release agents such as those listed above can affect the quality of the image printed.

There is a need in the art for a means to reduce or eliminate donor-receiver sticking while producing good quality images.

SUMMARY OF THE INVENTION

A print assembly is described, wherein the print assembly comprises a dye-donor element comprising a dye-donor layer, wherein the dye-donor element includes a donor stick preventative agent; and a receiver comprising a dye image-receiving layer, wherein the receiver includes a receiver stick preventative agent of the formula:

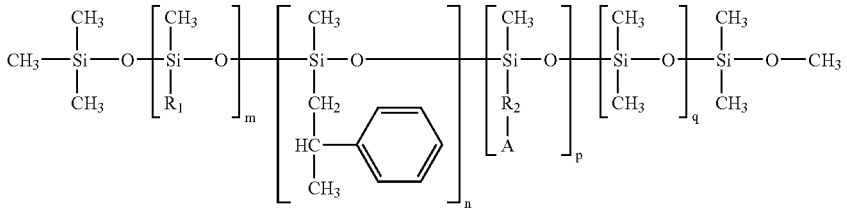

wherein $R_1$ is an alkyl chain of $C_9H_{19}$ or greater; $R_2$ is an alkyl chain of $C_3H_6$ or greater; A is NH—$R_3$, $NHNH_2$, NHCO—$R_3$, NH—$R_4$—$NH_2$, or NHCO—$R_4$—$NH_2$; $R_3$ is alkyl chain of $C_2H_5$ or greater; $R_4$ is an alkyl chain of $C_2H_4$ or greater; m is from about 0 to 95 weight percent; n is from about 0 to about 70 weight percent; p is from 0 to about 40 weight percent; and q is from 0 to 95 weight percent, with the proviso that when m is 0, then n is 0, and $R_3$ is an alkyl chain of $C_8H_{17}$ or greater, otherwise when m is greater than 0, n is from 0.1 to 70 weight percent, based on the total weight of the receiver stick preventative agent and wherein the dye-donor element and receiver are in superposed position such that the dye-donor layer is adjacent the dye image-receiving layer.

A method of forming an image using the print assembly is also described.

Use of the print assembly having a stick preventative agent in each of the dye-donor element and the receiver element can reduce or prevent sticking between the dye-donor element and the receiver element during printing, including printing at high speed, for example, line speeds of 2.0 ms or less, and can result in a good quality image.

DETAILED DESCRIPTION OF THE INVENTION

According to various embodiments, a print assembly having a dye-donor element including a stick preventative agent, and a receiver element including a stick preventative agent, can reduce or prevent donor-receiver sticking in thermal print assemblies. As used herein, "sticking" refers to adherence of a dye-donor element to a receiver element. Sticking can be detected by resultant defects in the dye-donor element or receiver element. For example, sticking can cause a removal of dye from the dye-donor element, appearing as a clear spot on the dye-donor element, or an over-abundance of dye on the receiver element. Sticking also can cause an uneven or spotty appearance on the dye-donor element. "Gross sticking" is when the dye-donor layer of the dye-donor element is pulled off of the support layer and sticks to the receiver element. This can appear as uneven and randomized spots across the dye-donor element and receiver element. "Microsticking" results in an undesirable image where a small area of the dye-donor element and receiver element stick together. Microsticking can be observed with a magnifying glass or microscope.

"Defect-free" or "defect-free image" as used herein refer to a printed image having no indication of donor-receiver sticking as set forth herein, and having no areas of dye-dropout in the image, wherein dye-dropout is defined as the absence of transfer of a dye-donor layer to the receiver element, or insufficient transfer of the dye-donor layer to the receiver element, on a pixel by pixel basis.

"Prints to fail" as used herein means the number of times an image can be printed with a print assembly as described herein at a temperature of about 8° C. with a print head having a voltage of about 16.7, before donor-receiver sticking. For example, a value of four prints to fail means no donor-receiver sticking occurs until at least the fifth print, and prints one through four are defect free. As used herein, a "print" refers to formation of an image on a receiver element using one dye patch on the dye-donor element.

The dye-donor element can include a dye-donor layer. The dye-donor layer can include one or more colored areas (patches) containing dyes suitable for thermal printing. As used herein, a "dye" can be one or more dye, pigment, colorant, or a combination thereof, and can optionally be in a binder or carrier as known to practitioners in the art. During thermal printing, at least a portion of one or more colored areas can be transferred to the receiver element, forming a colored image on the receiver element. The dye-donor layer can include a laminate area (patch) having no dye. The laminate area can follow one or more colored areas. During thermal printing, the entire laminate area can be transferred to the receiver element. The dye-donor layer can include one or more colored areas and one or more laminate areas. For example, the dye-donor layer can include three color patches, for example, yellow, magenta, and cyan, and a clear laminate patch, for forming a three color image with a protective laminate layer on a receiver element.

Any dye transferable by heat can be used in the dye-donor layer of the dye-donor element. For example, sublimable dyes can be used, such as but not limited to anthraquinone dyes, such as Sumikalon Violet RS® (product of Sumitomo Chemical Co., Ltd.), Dianix Fast Violet 3R-FS® (product of Mitsubishi Chemical Corporation.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Corporation) and Direct Brown M® and Direct Fast Black D® (products of Nippon Kayaku Co. Ltd.); acid dyes such as Kayanol Milling Cyanine 5R® (product of Nippon Kayaku Co. Ltd.); and basic dyes such as Sumicacryl Blue 6G® (product of Sumitomo Chemical Co., Ltd.), and Aizen Malachite Green® (product of Hodogaya Chemical Co., Ltd.); magenta dyes of the structures (magenta)

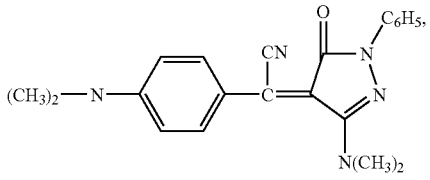

and

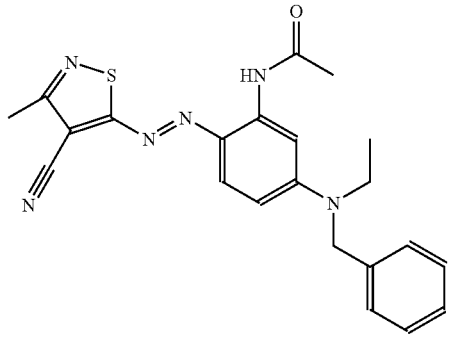

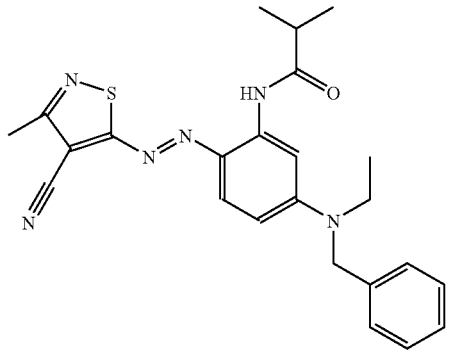

-continued

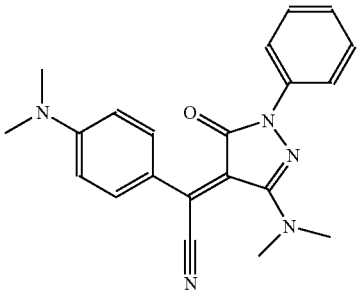

(cyan)

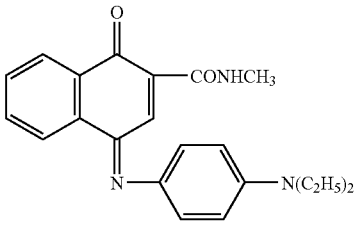

cyan dyes of the structures (cyan)

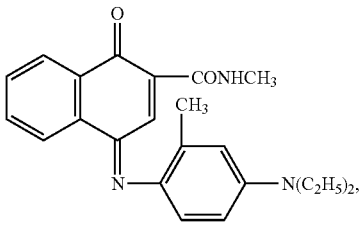

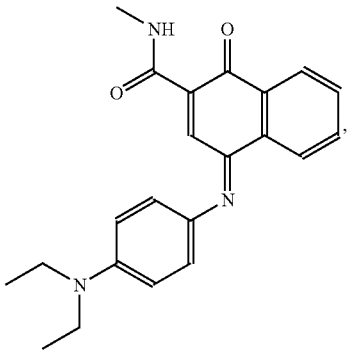

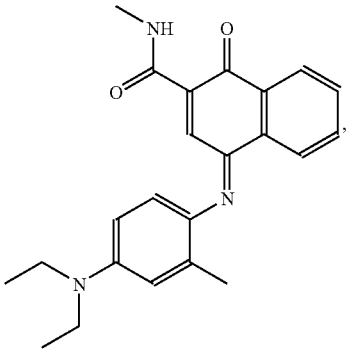

and

-continued

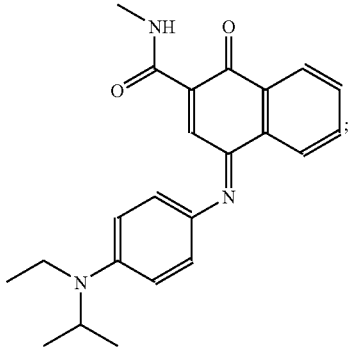

and yellow dyes of the structures

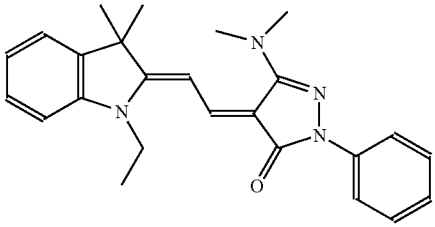

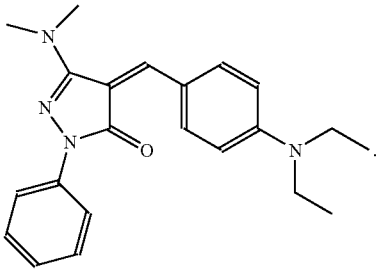

Other examples of dyes are set forth in U.S. Pat. No. 4,541,830, and are known to practitioners in the art. The dyes can be employed singly or in combination to obtain a monochrome dye-donor layer. The dyes can be used in an amount of from about 0.05 g/m$^2$ to about 1 g/m$^2$ of coverage. According to various embodiments, the dyes can be hydrophobic.

The dye-donor layer can have a dye to binder ratio for each color dye patch. For example, a yellow dye to binder ratio can be from about 0.3 to about 1.2, or from about 0.5 to about 1.0. A magenta dye to binder ratio can be from about 0.5 to about 1.5, or from about 0.8 to about 1.2. A cyan dye to binder ratio can be from about 1.0 to about 2.5, or from about 1.5 to about 2.0.

To form a dye-donor layer, one or more dyes can be dispersed in a polymeric binder, for example, a polycarbonate; a poly(styrene-co-acrylonitrile); a poly(sulfone); a poly (phenylene oxide); a cellulose derivative such as but not limited to cellulose acetate hydrogen phthalate, cellulose acetate, cellulose acetate propionate, cellulose acetate butyrate, or cellulose triacetate; or a combination thereof. The binder can be used in an amount of from about 0.05 g/m$^2$ to about 5 g/m$^2$.

The dye-donor layer of the dye-donor element can be formed or coated on a support. The dye-donor layer can be formed on the support by a printing technique such as but not limited to a gravure process, spin-coating, solvent-coating, extrusion coating, or other methods known to practitioners in the art.

The support can be formed of any material capable of withstanding the heat of thermal printing. According to various embodiments, the support can be dimensionally stable during printing. Suitable materials can include polyesters, for example, poly(ethylene terephthalate); polyamides; polycarbonates; glassine paper; condenser paper; cellulose esters, for example, cellulose acetate; fluorine polymers, for example, polyvinylidene fluoride, and poly (tetrafluoroethylene-cohexafluoropropylene); polyethers, for example, polyoxymethylene; polyacetals; polyolefins, for example, polystyrene, polyethylene, polypropylene, and methylpentane polymers; polyimides, for example, polyimide-amides and polyether-imides; and combinations thereof. The support can have a thickness of from about 2 μm to about 30 μm, for example, from about 3 μm to about 7 μm.

According to various embodiments, a subbing layer, for example, an adhesive or tie layer, a dye-barrier layer, or a combination thereof, can be coated between the support and the dye-donor layer. The adhesive or tie layer can adhere the dye-donor layer to the support. Suitable adhesives are known to practitioners in the art, for example, Tyzor TBT® from E.I. DuPont de Nemours and Company. The dye-barrier layer can include a hydrophilic polymer. The dye-barrier layer can provide improved dye transfer densities.

The dye-donor element can also include a slip layer capable of preventing the print head from sticking to the dye-donor element. The slip layer can be coated on a side of the support opposite the dye-donor layer. The slip layer can include a lubricating material, for example, a surface-active agent, a liquid lubricant, a solid lubricant, or mixtures thereof, with or without a polymeric binder. Suitable lubricating materials can include oils or semi-crystalline organic solids that melt below 100° C., for example, poly(vinyl stearate), beeswax, perfluorinated alkyl ester polyether, poly (caprolactone), carbowax, polyethylene homopolymer, or poly(ethylene glycol). Suitable polymeric binders for the slip layer can include poly(vinyl alcohol-co-butyral), poly (vinyl alcohol-co-acetal), poly(styrene), poly(vinyl acetate), cellulose acetate butyrate, cellulose acetate, ethyl cellulose, and other binders as known to practitioners in the art. The amount of lubricating material used in the slip layer is dependent, at least in part, upon the type of lubricating material, but can be in the range of from about 0.001 to about 2 g/m$^2$, although less or more lubricating material can be used as needed. If a polymeric binder is used, the lubricating material can be present in a range of 0.1 to 50 weight %, preferably 0.5 to 40 weight %, of the polymeric binder.

The dye-donor element can include a donor stick preventative agent to reduce or eliminate sticking between the dye-donor element and the receiver element during printing. The donor stick preventative agent can be present in any layer of the dye-donor element, so long as the donor stick preventative agent is capable of diffusing through the layers of the dye-donor element to the dye-donor layer. For example, the donor stick preventative agent can be present in one or more patches of the dye-donor layer, in the support, in an adhesive layer, in the dye-barrier layer, in the slip layer, or in a combination thereof. According to various embodiments, the donor stick preventative agent can be in the slip layer and the dye-donor layer. According to various embodiments, the donor stick preventative agent is in the dye-donor layer. The donor stick preventative agent can be in one or more colored patches of the dye-donor layer, or a combination thereof. If more than one dye patch is present in the dye-donor layer, the donor stick preventative agent can be present in the last patch of the dye-donor layer to be printed, typically the cyan layer. However, the dye patches can be in any order. For example, if repeating patches of cyan, magenta, and yellow are used in the dye-donor element, in that respective order, the yellow patches, as the last patches printed in each series, can include the donor stick preventative agent.

The amount of donor stick preventative agent suitable for use in the dye-donor element depends on several factors, for example, the composition of the dye-donor element, the composition of the receiver element, the donor stick preventative agent used, and the print conditions, such as print speed and print head voltage. The donor stick preventative agent can be used in an amount of about 0.02 g/m$^2$ or less, about 0.01 g/m$^2$ or less, about 0.005 g/m$^2$ or less, from about 0.0001 g/m$^2$ to about 0.01 g/m$^2$, from about 0.0003 g/m$^2$ to about 0.0015 g/m$^2$, or from about 0.0005 g/m$^2$ to about 0.001 g/m$^2$. More or less donor stick preventative agent can be used as needed to prevent donor-receiver sticking. If too much donor stick preventative agent is used, a reduction in film strength, a decrease in dye transfer properties, a discoloration of dye, reduced staying or stability of dyes, or a combination thereof can occur. If too little donor stick preventative agent is used, slight or no improvement in stick prevention can be seen.

The donor stick preventative agent can be a silicone- or siloxane-containing polymer. Suitable polymers can include graft co-polymers, block polymers, co-polymers, and polymer blends or mixtures. Suitable donor stick preventative agents can be used to prevent sticking of the dye-donor element and receiver element at high print speeds, for example, less than 4.0 ms/line, 2.0 ms/line or less, 1.5 ms/line or less, 1.0 ms/line or less, or 0.5 ms/line or less. Suitable donor stick preventative agents can also be used to prevent sticking at higher print head voltages, for example, voltages of 10 or more, or 20 or more. Suitable donor stick preventative agents can include those that provide a defect-free image on the receiver element, wherein the image has a density of at least two, while printing at high print speeds. Other suitable donor stick preventative agents can include those having a print to fail value of at least four while printing at high speeds.

The donor stick preventative agent can be selected from siloxane- or silicone-containing polymers such as, but not limited to, polydimethylsiloxanes, including polyalkyleneoxide modified polydimethylsiloxanes and acrylic functional polyester modified polydimethylsiloxanes; dimethylsiloxane-ethylene oxide block copolymers; polyalkyleneoxidimethylsiloxane copolymers; (polyethyleneoxide) siloxanes; cyclotetrasiloxanes, including octamethylcyclotetrasiloxane and phenylheptamethyl cyclotetrasiloxane; polymethyltetradecylsiloxanes; polymethyloctadecylsiloxanes; methyl-3,3,3-trifluoropropylsiloxanes; polypropyleneoxide siloxane copolymers; and combinations thereof. Further suitable stick preventative agents include, but are not limited to, epoxy functional silicones, and amine functional silicones. Other suitable donor stick preventative agents include polyoxyalkylene-modified dimethylsiloxane graft copolymers of the formula:

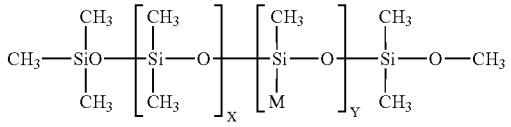

wherein

M is $-(C_3H_6-O)-(C_2H_4-O)_a-(C_3H_6-O)_b-R$,

R represents hydrogen or an alkyl group having from 1 to about 4 carbon atoms; X is 0 to 10; Y is 0.5 to 2; a is 0 to 100; b is 0 to 100; and a+b is greater than 45; and siloxane polymers of the formula:

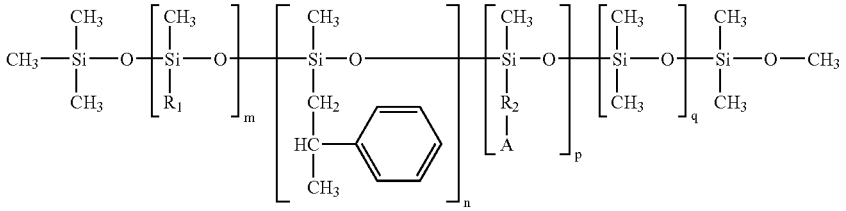

wherein $R_1$ is an alkyl chain of $C_9H_{19}$ or greater; $R_2$ is an alkyl chain of $C_3H_6$ or greater; A is NH—$R_3$, $NHNH_2$, NHCO—$R_3$, NH—$R_4$—$NH_2$, or NHCO—$R_4$—$NH_2$; $R_3$ is alkyl chain of $C_2H_5$ or greater; $R_4$ is an alkyl chain of $C_2H_4$ or greater; m is from about 0 to 95 weight percent; n is from about 0 to about 70 weight percent; p is from 0 to about 40 weight percent; and q is from 0 to 95 weight percent, with the proviso that when m is 0, then n is 0, otherwise when m is greater than 0, n is from 0.1 to 70 weight percent, based on the total weight of the stick preventative agent. According to various embodiments, m can be from about 20 to 80 weight percent, n can be from about 1 to about 80 weight percent, more preferably from about 20 to about 80 weight percent, and p can be from 20 to about 40 weight percent when n and m are both 0, or any combination thereof. $R_1$, $R_2$, $R_3$ and $R_4$ can each independently be selected from straight or branched alkyl chains, except that when m and n are both 0, $R_3$ is an alkyl chain of $C_8H_{17}$ or greater.

Exemplary donor stick preventative agents include, for example, Vybar 103 from Baker-Petrolite of Sugar Land, Tex., USA; BYK-371 from BYK-Chemie USA of Wallingford, Conn., USA; Silwet L-7230 and Silwet L-7001 from Crompton Corporation of Long Reach, W.Va., USA; Dow Corning 175, 163, 57, 56, 25, 18, and 11, Dow 190, DC510, and Dow Corning HV-490 Emulsion, all from Dow Corning of Midland, Mich., USA; Zonyl-9223B and Zonyl-FSG from E.I. DuPont de Nemours and Company of Wilmington, Del., USA); DBE-224 from Gelest of Tullytown, Pa., USA; GP-4, GP-6, GP-RA-157, GP-148, GP-134, GP-478, GP-70-S, GP-32, GP-446, GP-4-E, GP-5, GP-501, GP-502, GP-50-A, GP-530, GP-7100, GP-7102, GP-7104-E, GP-71-SS, GP-7200, and GP-RA-156, all from Genesee Polymers Corporation of Flint, Mich., USA; Pecosil FSL-150 from Phoenix Chemical of Somerville, N.J., USA; PST 433 and PST-503 from Polysi Technologies, Inc., of Avon, Ohio, USA; S-379N and SST-3 from Shamrock Chemical of Dayton, N.J., USA; Tegopren 7008 from Tego Chemie Service USA of Hopewell, Va., USA; PS-130, PS-134, PS-181, PS-183, and PS-187 from United Chemical Technologies of Bristol, Pa., USA; and combinations thereof. Other suitable donor stick preventative agents will be apparent to practitioners in the art upon study and practice of the invention disclosed herein.

Optionally, release agents as known to practitioners in the art can also be added to the dye-donor element, for example, to the dye-donor layer, the slip layer, or both. Suitable release agents include those described in U.S. Pat. Nos. 4,740,496 and 5,763,358.

The dye-donor element can be a sheet of one or more colored patches or laminate, or a continuous roll or ribbon. The continuous roll or ribbon can include one patch of a monochromatic color or laminate, or can have alternating areas of different patches, for example, one or more dye patches of cyan, magenta, yellow, or black, one or more laminate patches, or a combination thereof.

A receiver element for use in the print assembly can include a receiver stick preventative agent. The receiver stick preventative agent can be a siloxane polymer, comprising a polymeric backbone of alternating silicon and oxygen atoms. The terms "siloxane-containing polymer," "siloxane-based polymer," and "siloxane polymer" are herein used synonymously and mean that the polymer can be a copolymer, block copolymer, or graft polymer, wherein the polymer has non-siloxane polymer chains, and is of the formula:

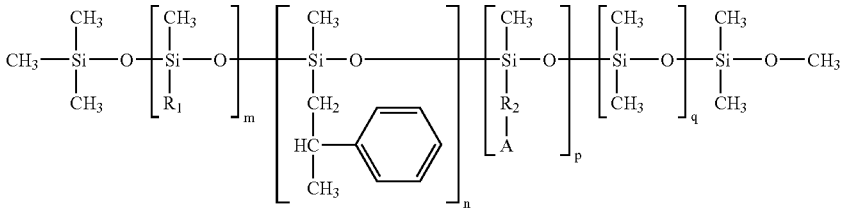

wherein $R_1$ is an alkyl chain of $C_9H_{19}$ or greater; $R_2$ is an alkyl chain of $C_3H_6$ or greater; A is NH—$R_3$, $NHNH_2$, NHCO—$R_3$, NH—$R_4$—$NH_2$, or NHCO—$R_4$—$NH_2$; $R_3$ is alkyl chain of $C_2H_5$ or greater; $R_4$ is an alkyl chain of $C_2H_4$ or greater; m is from about 0 to 95 weight percent; n is from about 0 to about 70 weight percent; p is from 0 to about 40 weight percent; and q is from 0 to 95 weight percent, with the proviso that when m is 0, then n is 0, otherwise when m is greater than 0, n is from 0.1 to 70 weight percent, based on the total weight of the receiver stick preventative agent. According to various embodiments, m can be from about 20 to 80 weight percent, n can be from about 1 to about 80 weight percent, more preferably from about 20 to about 80 weight percent, and p can be from 20 to about 40 weight percent when n and m are both 0, or any combination thereof. $R_1$, $R_2$, $R_3$ and $R_4$ can each independently be selected from straight or branched alkyl chains, except that when m and n are both 0, $R_3$ is an alkyl chain of $C_8H_{17}$ or greater.

The receiver stick preventative agent can be present in the receiver element in an amount of greater than or equal to about $5.5\times10^{-4}$ g/m$^2$. For example, the receiver stick preventative agent can be present in an amount of greater than or equal to about 0.001 g/m$^2$, from about $5.5\times10^{-4}$ g/m to about 0.045 g/m$^2$, from about $5.5\times10^{-4}$ g/m$^2$ to about 0.02 g/m$^2$, or from about 0.001 g/m$^2$ to about 0.01 g/m$^2$.

The receiver stick preventative agent can be present in one or more layers of the receiver element. For example, the receiver stick preventative agent can be present in the dye image-receiving layer, a support, an adhesive layer, a tie-layer, an antistatic layer, or any other layer of the receiver element. When the support is a composite or laminate structure, the receiver stick preventative agent can be in one or more layers of the support, for example, a base layer, a tie-layer, an adhesive layer, or a backing layer. According to various embodiments, the receiver stick preventative agent can be in a layer between the base layer of the support and the dye image-receiving layer.

The support for the receiver element can be a transparent film, for example, a poly(ether sulfone), a polyimide, a cellulose ester such as cellulose acetate, a poly(vinyl alcohol-co-acetal), or a poly(ethylene terephthalate). The support can be a reflective layer, for example, baryta-coated paper, white polyester (polyester with white pigment incorporated therein), an ivory paper, a condenser paper, or a synthetic paper, for example, DuPont Tyvek® by E.I. DuPont de Nemours and Company. The support can be employed at any desired thickness, for example, from about 10 μm to 1000 μm. Exemplary supports for the dye image-receiving layer are disclosed in commonly assigned U.S. Pat. Nos. 5,244,861 and 5,928,990, and in EP-A-0671281. Other suitable supports as known to practitioners in the art can also be used.

According to various embodiments, the support can be a composite or laminate structure comprising a base layer and one or more additional layers. The additional layers can include a tie-layer, an adhesive layer, an antistatic layer, a backing layer, a slip layer, or a combination thereof. The base layer can comprise more than one material, for example, a combination of one or more of a microvoided layer, a nonvoided layer, a synthetic paper, a natural paper, and a polymer.

The dye image-receiving layer can comprise a polymeric material chosen for its compatibility and receptivity for the dyes to be transferred from a dye-donor element. During printing, a dye can migrate rapidly from a dye-donor layer into the dye image-receiving layer during the dye transfer step. The dye image-receiving layer composition can immobilize the dye and stabilize the dye in an intended viewing environment.

The dye image-receiving layer can include a thermoplastic material, for example, a polyester, a polyolefin, a polycarbonate, a vinyl polymer, a polyurethane, a polyvinyl chloride, a poly(styrene-coacrylonitrile), a poly(caprolactone), or combinations thereof, such as blends or copolymers.

Polyester-polycarbonate blends suitable for the dye image-receiving layer can include unmodified bisphenol-A polycarbonates having a number molecular weight of at least about 25,000, such as those disclosed in U.S. Pat. No. 4,695,286. Specific examples include MAKROLON 5700 (Bayer AG) and LEXAN 141 (General Electric Co.) polycarbonates.

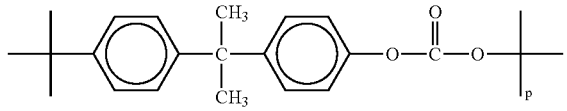

Lexan® 141: p~120, Tg~150° C.
Makrolon® 5700: p~280, Tg~157° C.

For polyester-polycarbonate blends, the polycarbonate can have a Tg of from about 100° C. to about 200° C., and the polyester can have a lower Tg than the polycarbonate. The Tg of the final polyester-polycarbonate blend can be between 40° C. and 100° C. Higher Tg polyester and polycarbonate polymers also can be useful.

According to various embodiments, the dye image-receiving layer can include a polyester having recurring dibasic acid derived units and diol derived units. A portion of the dibasic acid derived units, for example, at least about 50 mole %, can include dicarboxylic acid derived units having an alicyclic ring within two carbon atoms of each carboxyl group of the corresponding dicarboxylic acid. A portion of the diol derived units, for example, at least about 30 mole %, can have an aromatic ring not immediately adjacent to each hydroxyl group of the corresponding diol, or an alicyclic ring. Examples of such polyesters suitable for dye image-receiving layers include polyesters such as those found in U.S. Pat. No. 5,387,571.

In the case of an extrudable polyester, monomers (as a replacement for either a diacid and/or diol that has three or more functional groups, preferably one more multifunctional polyols or polyacids, and derivatives thereof) that can provide branching can be used, for example, multifunctional polyols, including but not limited to, glycerin, 1,1,1-trimethylolethane, 1,1,1-trimethylolpropane, and combinations thereof. Polyacids having more than two carboxylic acid groups (including esters or anhydrides derivatives thereof) include, for example, trimellitic acid, trimesic acid, 1,2,5-, 2,3,6- or 1,8,4-naphthalene tricarboxylic anhydride, 3,4,4'-diphenyltricarboxylic anhydride, 3,4,4'-diphenylmethanetricarboxylic anhydride, 3,4,4'-diphenylethertricarboxylic anhydride, 3,4,4'-benzophenonetricarboxylic anhydride acid, and derivatives thereof. Multifunctional polyols or anhydrides, for example, include compounds represented by the following structures:

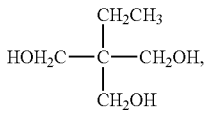

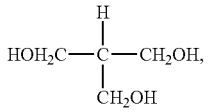

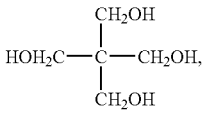

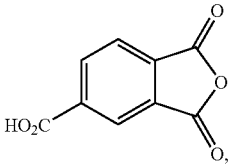

and

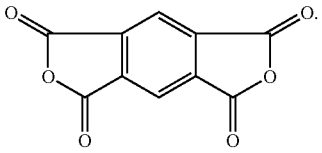

Examples of such extrudable branched polyesters include, for example, 1,4-cyclohexanedicarboxylic acid, 1,4-cyclohexanedimethanol, 4,4'-bis(2-hydroxyethyl)bisphenol-A, and 2-ethyl-2-(hydroxymethyl)-1,3-propanediol.

Various polymerization catalysts known to practitioners in the art can be used to make the polymers, for example, polyesters, for the dye-image receiving layer. For example, a catalyst can be added in the amount of from about 0.01% to about 0.08% by weight solids to the polymer composition of the dye image-receiving layer to prevent or minimize transesterification.

A plasticizer can be present in the dye image-receiving layer in any effective amount. For example, the plasticizer can be present in an amount of from about 5% to about 100%, or from about 4% to about 30%, based on the weight of the polymer in the dye-image receiving layer. According to various embodiments, an aliphatic ester plasticizer can be used in the dye-image receiving layer. Suitable aliphatic ester plasticizers can include both monomeric esters and polymeric esters. Examples of aliphatic monomeric esters include ditridecyl phthalate, dicyclohexyl phthalate, and dioctylsebacate. Examples of aliphatic polyesters include polycaprolactone, poly(butylene adipate) and poly(hexamethylene sebacate). Various aliphatic ester plasticizer, including polyesters or monomeric esters, are disclosed in U.S. Pat. No. 6,291,396. Phthalate ester plasticizers are disclosed in U.S. Pat. No. 4,871,715.

The dye image-receiving layer can be formed on the support by any method known to practitioners in the art, including but not limited to printing, solution coating, dip coating, and extrusion coating. If the dye image-receiving layer is made by extrusion coating, and the layer includes the stick preventative agent, the stick preventative agent is of the formula wherein p is 0.

Wherein the dye image-receiving layer is extruded, the process can include (a) forming a melt comprising a thermoplastic material; (b) extruding or coextruding the melt as a single-layer film or a layer of a composite (multilayer or laminate) film; and (c) applying the extruded film to the support for the receiver element. In step (b), the melt can be extruded and cast as a film or laminate film at a thickness of at least 100 microns, for example, 100 to 800 microns, and then uniaxially or biaxially stretched to less than 10 microns, for example, 3–4 microns. The extruded uniaxially or biaxially stretched film can be applied to the support, for example, a moving web. Examples of suitable extruded dye image-receiving layers include those disclosed in U.S. Pat. Nos. 5,387,571 and 5,302,574. According to various embodiments, a tie-layer can be used for adhering the extruded dye-receiving layer to the support.

When the dye image-receiving layer is made by high temperature melt extrusion, a phosphorous-containing stabilizer can be added to the dye image-receiving layer to prevent degradation of the polyester polymer blend during extrusion. The phosphorous-containing stabilizer can be a phosphorous acid, an organic diphosphite such as bis(2-ethylhexyl)phosphite, a phosphate, an alkyl phosphate, an aryl phosphate, an inorganic phosphate, a phosphoric acid ester, or a phosphorous acid. The phosphorous stabilizer can be combined with a plasticizer such as dioctyl sebacate or the like. To improve compatibility, the plasticizer can be combined with the stabilizer prior to combining both with other components of the dye image-receiving layer.

The dye image-receiving layer can be present in an amount which is effective for its intended purpose. For example, the dye image-receiving layer can be in a concentration of from about 0.5 $g/m^2$ to about 20 $g/m^2$, 1.0 $g/m^2$ to 15 $g/m^2$, or 3.0 $g/m^2$ to 10 $g/m^2$. The dye image-receiving layer can be present on one or both sides of the support.

According to various embodiments, the receiver element can include a tie-layer between the support and the dye image-receiving layer. The tie-layer can be a conventional material capable of adhering the support and dye image-receiving layer together. The tie-layer can comprise a thermoplastic polymer having preselected antistatic properties, adhesive properties, or viscoelastic properties.

According to various embodiments, the tie-layer can have viscoelastic properties such that the viscosity is not more than 10 times or less than 1/10, or not more than 3 times or less than 1/3, that of the dye-image receiving layer.

According to various embodiments, the tie-layer can have antistatic properties. Suitable materials for use as the antistatic tie-layer include PELLESTAT 300 polymer, commercially available from Sanyo Chemical Industries, Ltd. (Tokyo) or Tomen America, Inc. (New York, N.Y.), PEBAX copolymer, commercially available from Atofina (Finland), polymers disclosed in EP-A-1,167,425, and other polymers as known to practitioners in the art.

Other materials known in the art that can be melt processed while retaining their antistatic activity and overall physical performance are various polymeric substances containing a high concentration of polyether blocks. Ionic conduction along the polyether chains can make these polymers inherently dissipative. Exemplary ionic conductors can include polyether-block-copolyamide (U.S. Pat. Nos. 4,115,475; 4,195,015; 4,331,786; 4,839,441; 4,864,014; 4,230,838; 4,332,920; and 5,840,807), polyetheresteramide (U.S. Pat. Nos. 5,604,284; 5,652,326; 5,886,098), and a thermoplastic polyurethane containing a polyalkylene glycol moiety (U.S. Pat. Nos. 5,159,053 and 5,863,466). Such inherently dissipative polymers (IDPs) have been shown to be thermally stable and readily processable in the melt state in their neat form, or in blends with other thermoplastic materials. Other known inherently conductive polymers (ICPs), for example, polyaniline, polypyrrole, and polythiophene, can be sufficiently thermally stable if a compatibilizer is added.

According to various embodiments, the antistatic tie-layer and the dye-image receiving layer can be coextruded. For example, a first melt and a second melt can be formed, wherein the first melt comprises a polymer for the dye image-receiving layer and the second melt comprises the thermoplastic antistatic polymer having desirable adhesive and viscoelastic properties. The coextruded layers, or composite film, can be stretched to reduce the thickness. The extruded and stretched film can be applied to a support of the receiver element at a temperature below the Tg of the dye image-receiving layer. According to various embodiments, this can be done by quenching the extruded film between two nip rollers.

According to various embodiments wherein the tie-layer and dye image-receiving layer are coextruded, a compatibilizer layer can be added to ensure compability between the layers by controlling phase separation. Exemplary compatibilizers can include those described in U.S. Pat. No. 6,436,619, EP-A-0,342,066, and EP-A-0,218,665. Further examples of compatibilizers can include, but are not limited to: polyethylene, polypropylene, ethylene/propylene copolymers, ethylene/butene copolymers, grafts of the above with maleic anhydride or glycidyl methacrylate; ethylene/alkyl(meth)acrylate/maleic anhydride copolymers, the maleic anhydride being grafted or copolymerized; ethylene/vinyl acetate/maleic anhydride copolymers, the maleic anhydride being grafted or copolymerized; the two above copolymers in which anhydride is replaced fully or partly by glycidyl methacrylate; ethylene/(meth)acrylic acid copolymers and their salts; ethylene/alkyl (meth)acrylate/glycidyl methacrylate copolymers, the glycidyl methacrylate being grafted or copolymerized; and grafted copolymers constituted by at least one mono-amino oligomer of polyamide and of an alpha-mono-olefin (co)polymer grafted with a monomer able to react with the amino functions of said oligomer. Other exemplary compatibilizers can include terpolymers of ethylene/methyl acrylate/glycidyl methacrylate and copolymers of ethylene/glycidyl methacrylate, commercially available as LOTADER from Atofina, or maleic anhydride grafted or copolymerized polyolefins such as polypropylene, or polyethylene, commercially available as OREVAC from Atofina.

The dye image-receiving layer, or an overcoat layer thereon, additionally can include a release agent as is conventional in the art. Various exemplary release agents are disclosed, for example, in U.S. Pat. Nos. 4,820,687 and 4,695,286, and can include, for example, Silwet L-7230 and Silwet L-7001 from Crompton Corporation of Long Reach, W.Va., USA; and solid polydimethylsiloxanes such as but not limited to MB50-315 silicone, a 50:50 blend of bisphenol-A polycarbonate and ultrahigh MW polydimethyl siloxane, from Dow Corning of Midland, Mich., USA.

The print assembly can be formed when be placing the dye-donor element and the receiver element described herein in superposed relationship such that the dye-donor layer of the dye-donor element is adjacent the dye image-receiving layer of the receiver element. An image can be formed by passing the print assembly past a print head, wherein the print head is located on the side of the dye-donor element opposite the receiver element. The print head can apply heat image-wise to the dye-donor element, causing the dyes in the dye-donor layer to transfer to the dye image-receiving layer of the receiver element.

Thermal print heads that can be used with the print assembly are available commercially and known to practitioners in the art. Exemplary thermal print heads can include, but are not limited to, a Fujitsu Thermal Head (FTP-040 MCSOO1), a TDK Thermal Head F415 HH7-1089, and a Rohm Thermal Head KE 2008-F3.

When multiple color images are to be obtained, the print assembly is formed as many times as there are colors to be printed during the time when heat is applied by the thermal print head. After the first dye is transferred from a first dye-donor element, the dye-donor element and receiver element can be peeled apart. A second dye-donor element (or another area of the dye-donor element with a different dye) can be brought into register with the receiver element and the process can be repeated until all colors are printed. A laminate patch can also be printed on the image in this manner to protect the image.

The print assembly including a donor stick preventative agent and a receiver stick preventative agent as described herein provides reduced donor-receiver sticking, and provides a good quality image, for example, an image with a print density greater than or equal to 2.0. The print assembly also can provide reduced donor-receiver sticking at high print speeds, for example, less than 2.0 ms/line.

The following example is provided to further illustrate the invention.

EXAMPLE

A thermal print assembly was constructed form a receiver element and dye-donor element. The materials and methods are set forth below.

As used herein, MB50-315 is a commercially available 50:50 blend of bisphenol-A polycarbonate and ultrahigh MW polydimethyl siloxane from Dow Chemical Co., GP-70-S is a methylalkylaryl silicone from Genesee Polymers Corp., $H_3PO_3$ is phosphorous acid, PES is a polyester derived from 1,4-cyclohexanedicarboxylic acid, 1,4-cyclohexanedimethanol, 4,4'-bis(2-hydroxyethyl)bisphenol-A, and 2-ethyl-2-(hydroxymethyl)-1,3-propanediol, PC is bisphenol A polycarbonate, known as GE Lexan 151, obtained from General Electric Co; and DOS is dioctyl sebacate.

Receiver Element:

The receiver element was made as follows using the compositions of Table 1, wherein all compounds set forth in Table 1 are in percent by weight of the dye image-receiving layer:

TABLE 1

| Sample | MB50-315 | GP-70S | PES | PC | DOS | $H_3PO_3$ |
|---|---|---|---|---|---|---|
| DRL-1 | 3 | — | 73.46 | 18.19 | 5.33 | 0.02 |
| DRL-2 | 3 | 0.8 | 72.8 | 18.05 | 5.33 | 0.02 |
| DRL-3 | 3 | 1.2 | 72.51 | 17.94 | 5.33 | 0.02 |

The receiver element was prepared by first extrusion laminating a paper core with a 36 μm thick microvoided composite film (OPPalyte 350 K18, ExxonMobil) on one side of the paper, and a backing layer (MLT-70, ExxonMobil) on the other side of the paper core opposite to the microvoided composite film, as disclosed in U.S. Pat. No. 5,858,916.

The composite film side of the resulting laminate was then extrusion coated with a tie-layer and dye image-receiving layer, the tie-layer being in direct contact with the microvoided composite film. The tie-layer and dye image-receiving layers according to Table 1 were formed as follows:

PES was dried in a NOVATECH desiccant dryer at 43° C. for 24 hours. The dryer was equipped with a secondary heat exchanger so that the temperature did not exceed 43° C. during the time the desiccant was recharged. The dew point was −40° C.

LEXAN 151 polycarbonate from General Electric Co., and MB50-315 silicone (a blend of bisphenol-A polycarbonate and ultrahigh MW polydimethyl siloxane at a 50:50 blend ratio) from Dow Chemical Co. as needed according to Table 1, were mixed in a ratio based on the percent compositions stated in Table 1, and dried at 120° C. for 2–4 hours at −40° C. dew point.

Dioctyl Sebecate ('DOS) was preheated to 83° C., and then phosphorous acid was added after heating, in amounts according to Table 4. GP-70S according to Table 1 was added to the heated dioctyl sebecate/phosphorous acid solution. This mixture was maintained at 83° C. and mixed for 1 hour under nitrogen before use.

Each of the dye image-receiving materials according to Table 4 was subjected to a compounding operation. The compounding was done in a LEISTRITZ ZSK 27 extruder with a 30:1 length to diameter ratio. The LEXAN-polycarbonate/MB50-315-silicone material was introduced into the compounder first, and melted. The heated dioctyl sebecate/phosphorous acid solution was added, and the PES was added last. A vacuum of slightly negative pressure was then applied to the mixture, and a temperature of 240° C. was maintained. The melted mixture was extruded through a strand die, cooled in 32° C. water, and pelletized. The pelletized dye image-receiving layer material was aged for about two weeks. After the two weeks, the pellets were predried at 38° C. for 24 hours in a NOVATECH dryer, under the conditions described above. The dried pellets were conveyed to an extruder (described below) using desiccated air.

The dye image-receiving layer pellets were introduced into a liquid cooled hopper feeding a 6.3 cm single screw BLACK CLAWSON extruder having a 6.3 cm long cooling section in the beginning of the extruder, cooled by 20° C. water. The screw was a standard compression screw with a single mixer. The pellets were melted in the extruder by heating to a temperature of 238° C. The pressure was increased through a melt pump, and the melted composition was pumped to a CLEOREN coextrusion feedblock with AAABB configuration.

A tie-layer was also compounded. PELESTAT 300 antistatic polymer from Sanyo Chemical Co. was predried as described above in the NOVATECH dryer at 77° C. for 24 hours. After drying, the polymer was melt-mixed in the LEISTRITZ ZSK 27 extruder with undried HUNTSMAN P4G2Z-159 polypropylene homopolymer in a 70/30 ratio at about 240° C., then forced through a strand die into 20° C. water and pelletized. The compounded tie-layer pellets were dried again at 77° C. for 24 hours in a NOVATECH dryer, and conveyed by desiccated air to the extruder.

The tie-layer pellets were introduced into a liquid cooled hopper of a second 6.3 cm single screw extruder as described above. The tie-layer pellets were heated to 238° C., and pumped to the CLEOREN coextrusion feedblock.

The volumetric ratio of dye image-receiving layer material to tie-layer material was about 3:1. The dye image-receiving layer material and the tie-layer material were brought into intimate contact in the CLOEREN feedblock, and passed to a standard extrusion coating T-die made by Cloeren, having a slot of 0.8 mm, and a land length of 2.5 mm. The die formed a melt curtain traveling 19 cm through the air before being coated onto the laminate support comprising a paper core extrusion laminated with a 38 μm thick microvoided composite film (OPPalyte® 350TW, Mobile Chemical Co., disclosed in U.S. Pat. No. 5,244,861).

The melt curtain was immediately quenched in a nip between a chill roll and the laminate support. The chill roll was operated at 21° C. The thickness of the coated die image-receiving layer was 3 μm, and the thickness of the coated tie-layer was 1 μm. The resultant coated paper was wound onto a roll and converted to the necessary dimensions for the thermal printing operation.

Dye-Donor Element:

The dye-donor elements were made as follows, using donor stick preventative agent Silwet L7230 as set forth in Table 2.

TABLE 2

| Sample | L7230 $g/m^2$ |
|---|---|
| DDL-1 | — |
| DDL-2 | 0.0006 |
| DDL-3 | 0.0003 |

The dye-donor element was prepared by coating sequential areas of cyan, magenta, and yellow dye in the order recited on 4.5 micron poly(ethylene terephthalate) support. The dye side was prepared by first coating a subbing layer of a titanium alkoxide (DuPont Tyzor TBT®) (0.12 $g/m^2$) from n-propyl acetate and n-butyl alcohol solvent mixture.

The cyan dye patch contained cyan dye #1 at 0.086 $g/m^2$, cyan dye #2 at 0.08 $g/m^2$, and cyan dye #3 at 0.2 $g/m^2$, cellulose acetate propionate binder at 0.21 $g/m^2$, polyester sebacate (Paraplex G-25) at 0.015 $g/m^2$, divinyl benzene beads at 0.008 $g/m^2$, and Silwet L-7230 according to Table 2, coated from a solvent mixture containing 70% toluene, 20% methanol, and 5% cyclopentanone.

cyan dye #1

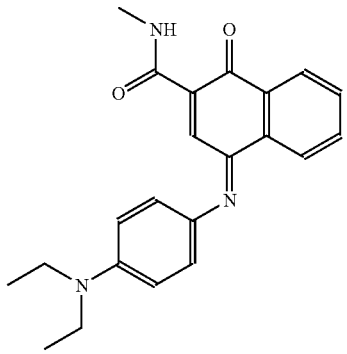

cyan dye #2

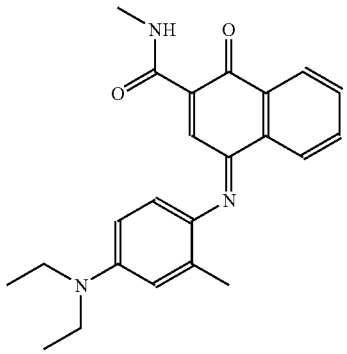

-continued cyan dye #3

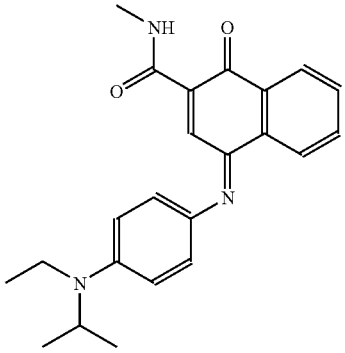

The yellow dye donor patch contained yellow dye #1 at 0.067 g/m$^2$, yellow 5 dye #2 at 0.084 g/m$^2$, cellulose acetate propionate binder at 0.24 g/m$^2$, polyester sebacate (Paraplex G-25) at 0.044 g/m$^2$, and divinyl benzene beads at 0.0034 g/m$^2$, coated from a solvent mixture containing 70% toluene, 20% methanol, and 5% cyclopentanone.

Yellow dye #1

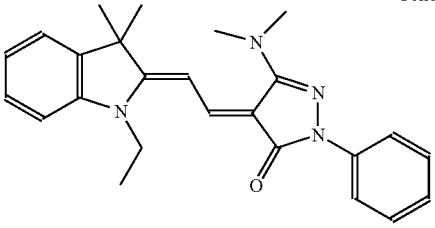

Yellow Dye #2

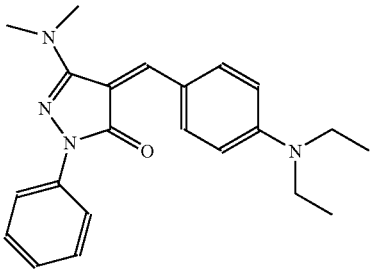

The magenta dye patch contained magenta dye #1 at 0.07 g/m$^2$, magenta dye #2 at 0.14 g/m$^2$, and magenta dye #3 illustrated below at 0.016 g/m$^2$, cellulose acetate 15 propionate binder at 0.29 g/m$^2$, polyester sebacate (Paraplex G-25) at 0.05 g/m$^2$, and divinyl benzene beads at 0.005 g/m$^2$, coated from a solvent mixture containing 70% toluene, 20% methanol, and 5% cyclopentanone.

Magenta dye #1

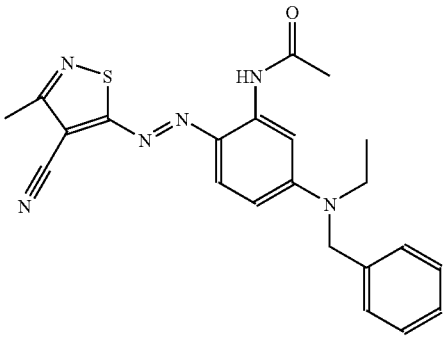

-continued

Magenta dye #2

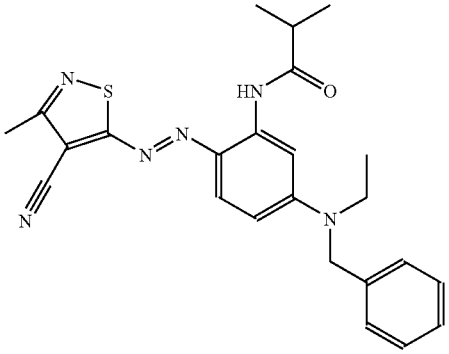

Magenta dye #3

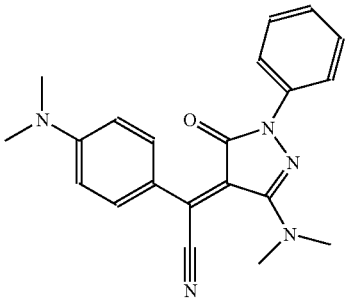

On the reverse side a slipping layer was prepared by coating the following layers in the order recited on 4.5 micron poly(ethylene terephthalate) support. First a subbing layer of a titanium alkoxide (DuPont Tyzor TBT®) (0.12 g/m2) was coated from n-propyl acetate and n-butyl alcohol solvent mixture, then a slipping layer containing an amino-propyl-dimethyl-terminated polydimethylsiloxane, PS513® (United Chemical Technologies) (0.01 g/m$^2$), a poly(vinyl acetal) binder (0.36 g/m$^2$) (Sekisui KS-1), p-toluenesulfonic acid (0.0003 g/m$^2$), candellila wax (0.02 g/m$^2$), and polymethylsisqiloxane (0.05 g/m$^2$), was coated from a solvent mixture of diethylketone, methanol and distilled water (86.5/11.5/2).

Test Procedure:

The above prepared dye-donor elements and receiver element were joined as a print assembly, as described herein, and subjected to thermal printing using a Kodak 8670 PS printer. An 11-step black and white image of optical density (OD) ranging from $D_{min}$ (OD<0.2) to $D_{max}$ (OD>2.0) was printed for each dye-donor element-receiver element combination shown in the table below. Donor-receiver sticking performance and image quality (toe) were observed according to the following criteria.

Donor-receiver sticking was noted where any portion of the donor or receiver was observed to have drop-outs, total dye-donor layer transfer, spots, or other indicia of sticking as described herein.

To determine if the toe was acceptable, the neutrality of the image was visually assessed. An unacceptable image was one where low density areas in the image were too cyan in appearance to be accepted in a black and white image.

The results of the testing are shown in Table 3. Dye image-receiving layer DRL-3 shown in Table 1 was not used as an example because the high amount of stick preventative agent GP-70S used in the dye image-receiving layer formulation caused problems with the extrusion coating process, including intermittent and non-uniform material transport in the extruder barrel.

TABLE 3

| Sample | Donor | Receiver | Sticking | Cyan Toe |
|---|---|---|---|---|
| C-1 | DDL-1 | DRL-1 | yes | acceptable |
| C-2 | DDL-1 | DRL-2 | yes | acceptable |
| C-3 | DDL-2 | DRL-1 | no | not acceptable |
| C-4 | DDL-2 | DRL-2 | no | not acceptable |
| C-5 | DDL-3 | DRL-1 | yes | acceptable |
| E-1 | DDL-3 | DRL-2 | no | acceptable |

The examples show the results of adding stick preventative agents to the dye-donor layer, the dye image-receiving layer, or both. Example C-1 contained no stick preventative agent and showed both sticking and unacceptable toe.

Examples C-3 and C-5 show stick preventative agent in the dye-donor layer only, in differing amounts. Example C-3 demonstrates that a higher amount of stick preventative agent in the donor (0.06 g/m$^2$) caused problems in toe, while reduction of the stick preventative agent amount to 0.03 g/m$^2$ in Example C-5 corrected the toe, while causing sticking.

Example C-2 shows stick preventative agent in the dye image-receiving layer only, which results in unacceptable toe. Example C-4 additionally provides stick preventative agent in the dye-donor layer in an amount of 0.06 g/m$^2$, but also results in problems in toe.

Example E-1 includes a stick preventative agent in both the dye-donor layer and the dye image-receiving layer. As compared to Example C-4, Example E-1 has less stick preventative agent in the dye image-receiving layer, producing acceptable results with regard to both toe and donor-receiver sticking.

As seen from the examples, a combination of a stick preventative agent in a dye-donor layer with a stick preventative agent in a dye image-receiving layer provides a synergistic effect in overcoming donor-receiver sticking, while minimizing the amount of stick preventative agent needed in one or both of the dye-donor layer and the dye image-receiving layer.

The invention has been described in detail with particular reference to preferred embodiments thereof, but it will be understood that variations and modifications can be effected within the spirit and scope of the invention.

What is claimed is:

1. A print assembly comprising:

a dye-donor element comprising a dye-donor layer, wherein the dye-donor element includes a donor stick preventative agent; and a receiver comprising a dye image-receiving layer, wherein the receiver includes a receiver stick preventative agent of the formula:

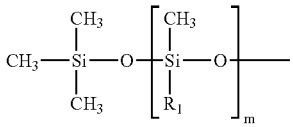

-continued

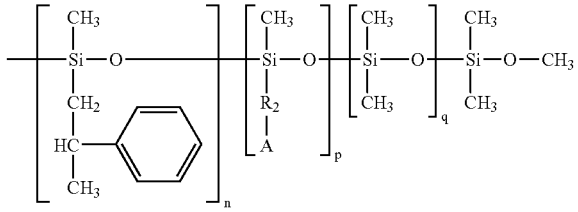

wherein $R_1$ is an alkyl chain of $C_9H_{19}$ or greater; $R_2$ is an alkyl chain of $C_3H_6$ or greater; A is NH—$R_3$, $NHNH_2$, NHCO—$R_3$, NH—$R_4$—$NH_2$, or NHCO—$R_4$—$NH_2$, $R_3$, is an alkyl chain of $C_2H_5$ or greater; $R_4$ is an alkyl chain of $C_2H_4$ or greater; m is from about 0 to 95 weight percent; n is from about 0 to about 70 weight percent; p is from 0 to about 40 weight percent; and q is from 0 to 95 weight percent, with the proviso that when m is 0, then n is 0, and $R_3$ is an alkyl chain of $C_8H_{17}$, or greater, otherwise when m is greater than 0, n is from 0.1 to 70 weight percent, based on the total weight of the receiver stick preventative agent; and wherein the dye-donor element and receiver are in superposed position such that the dye-donor layer is adjacent the dye image-receiving layer.

2. The print assembly of claim 1, wherein the receiver stick preventative agent is of the formula wherein p is 0.

3. The print assembly of claim 1, wherein the receiver stick preventative agent is in the dye image-receiving layer of the receiver.

4. The print assembly of claim 3, wherein the dye image-receiving layer is extrusion coated on a support, and the receiver stick preventative agent has the formula wherein p is 0.

5. The print assembly of claim 1, wherein the receiver stick preventative agent is present in an amount greater than or equal to $5.5\times10^{-4}$ g/m$^2$.

6. The print assembly of claim 1, wherein the receiver stick preventative agent is present in an amount of from about $5.5\times10^{-4}$ g/m$^2$ to about 0.022 g/m$^2$.

7. The print assembly of claim 1, wherein the donor stick preventative agent is in the dye-donor layer.

8. The print assembly of claim 7, wherein the dye-donor element further comprises a slip layer, and wherein the donor stick preventative agent is present in the slip layer.

9. The print assembly of claim 1, wherein the dye-donor element further comprises at least one of a substrate, or an adhesive layer, and wherein the donor stick preventative agent is present in one or more of the substrate, or adhesive layer.

10. The print assembly of claim 1, wherein the donor stick preventative agent is added in an amount of from about 0.001 g/m$^2$ to about 0.01 g/m$^2$.

11. The print assembly of claim 1, wherein the donor stick preventative agent comprises a polydimethylsiloxane, a polyalkyleneoxide modified polydimethylsiloxane, an acrylic functional polyester modified polydimethylsiloxane, a dimethylsiloxane-ethylene oxide block copolymer; a polyalkyleneoxidimethylsiloxane copolymer; a (polyethyleneoxide) siloxane, a cyclotetrasiloxane, an octamethylcyclotetrasiloxane, a phenyiheptamethyl cyclotetrasiloxane, a polymethyltetradecylsiloxane, a polymethyloctadecylsiloxane, a methyl-3,3,3-trifluoropropylsiloxane, a polypropyleneoxide siloxane copolymer; an epoxy functional silicone, an amine functional silicone, an alpha-methyl styrene, a hexamethoxymethyl melamine, a polytetrafluoroethylene, or a polyoxyalkylene-modified dimethylsiloxane graft copolymer of the formula:

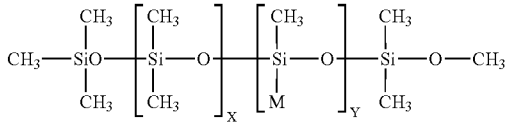

wherein

M is $-(C_3H_6-O)-(C_2H_4-O)_a-(C_3H_6-O)_b-R$,

R represents hydrogen or an alkyl group having from 1 to about 4 carbon atoms; X is 0 to 10; Y is 0.5 to 2; a is 0 to 100; b is 0 to 100; and a+b is greater than 45; or a combination thereof.

12. The print assembly of claim 1, wherein the donor stick preventative agent is the same as the receiver stick preventative agent.

13. The print assembly of claim 1, wherein the print assembly is capable of print speeds less than 4 ms/line.

14. The print assembly of claim 1, wherein the print assembly is capable of print speeds less than 2 ms/line.

15. The print assembly of claim 1, wherein the print assembly is capable of print speeds less than 1.5 ms/line.

16. The print assembly of claim 1, wherein the print assembly is capable of producing an image with a print to fail value of at least four.

17. The print assembly of claim 1, wherein the print assembly is capable of producing an image with a density of at least two.

18. The print assembly of claim 17, wherein the print assembly is capable of print speeds less than 2 ms/line.

19. A method of forming an image, comprising:

forming the print assembly of claim 1;

positioning the dye-donor element of the print assembly adjacent a thermal print head;

imagewise heating the thermal printhead, transferring dye from the dye-donor layer to the receiver to form an image on the receiver; and separating the dye-donor element and receiver to expose the image.

20. The method of claim 19, wherein imagewise heating the thermal printhead occurs at a line speed of less than 4 ms/line.

21. The method of claim 19, wherein imagewise heating the thermal printhead occurs at a line speed of 2 ms/line or less.

22. The method of claim 19, wherein the image has a density of at least two.

23. The method of claim 19, wherein a print to fail value of at least 4.

24. The print assembly of claim 1, wherein the receiver stick preventative agent has the formula wherein m and n are both 0.

25. A thermal receiver element comprising a dye image-receiving layer, wherein the receiver element includes a stick preventative agent of the formula:

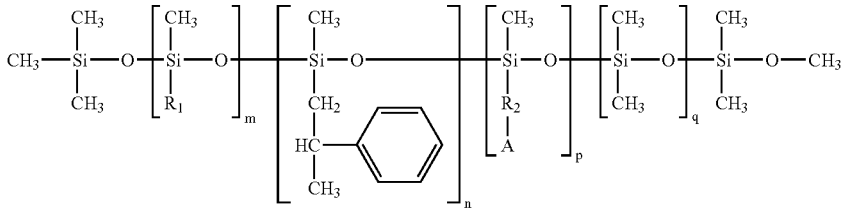

wherein $R_1$ is an alkyl chain of $C_9H_{19}$ or greater; $R_2$ is an alkyl chain of $C_3H_6$ or greater; A is NH—$R_3$, $NHNH_2$, NHCO—$R_3$, NH—$R_4$—$NH_2$, or NHCO—$R_4$—$NH_2$; $R_3$ an alkyl chain of $C_2H_5$ or greater; $R_4$ is an alkyl chain of $C_2H_4$ or greater; m is from about 0 to 95 weight percent; n is from about 0 to about 70 weight percent; p is from 0 to about 40 weight percent; and q is from 0 to 95 weight percent, with the proviso that when m is 0, then n is 0, and $R_3$ is an alkyl chain of $C_8H_{17}$, or greater, otherwise when m is greater than 0, n is from 0.1 to 70 weight percent, based on the total weight of the stick preventative agent.

26. The thermal receiver element of claim 25, wherein the stick preventative agent is in the dye image-receiving layer.

27. The thermal receiver element of claim 26, wherein the dye image-receiving layer is extrusion coated on a support, and the stick preventative agent has the formula wherein p is 0.

28. The thermal receiver element of claim 26, wherein the stick preventative agent has the formula wherein m and n are both 0.

29. The thermal receiver element of claim 26, wherein the stick preventative agent has the formula wherein p is 0.

30. The thermal receiver element of claim 25, wherein the receiver further comprises a support including the stick preventative agent.

31. The thermal receiver element of claim 25, wherein the stick preventative agent is present in an amount greater than or equal to $5.5\times10^{-4}$ g/m$^2$.

32. The thermal receiver element of claim 25, wherein the stick preventative agent is present in an amount of from about $5.5\times10^{-4}$ g/m$^2$ to about 0.022 g/m$^2$.

33. The thermal receiver element of claim 25, further comprising a release agent.

34. The thermal receiver element of claim 33, wherein the release agent is a solid polydimethylsiloxane.

35. The thermal receiver element of claim 34, wherein the release agent is a blend of bisphenol-A polycarbonate and polydimethyl siloxane.

36. A print assembly comprising a dye-donor element including a dye-donor layer, and a receiver element of claim 25, wherein the dye-donor element and receiver element are in superposed position such that the dye-donor layer is adjacent the dye image-receiving layer.

37. The print assembly of claim 36, wherein the stick preventative agent is in the dye image-receiving layer.

38. The print assembly of claim 37, wherein the dye image-receiving layer is extrusion coated, and the stick preventative agent has the formula wherein p is 0.

39. A method of forming an image, comprising:

forming the print assembly of claim 36;

positioning the dye-donor element of the print assembly adjacent a thermal print head;

imagewise heating the thermal print head, transferring dye from the dye-donor layer to the receiver element to form an image on the receiver element; and separating the dye-donor element and receiver element to expose the image.

* * * * *

UNITED STATES PATENT AND TRADEMARK OFFICE

CERTIFICATE OF CORRECTION

PATENT NO. : 7,135,433 B2
APPLICATION NO. : 10/729215
DATED : November 14, 2006
INVENTOR(S) : David G. Foster et al.

It is certified that error appears in the above-identified patent and that said Letters Patent is hereby corrected as shown below:

| | |
|---|---|
| Title Page, Col. 2, line 9; item (57) (Abstract); | After "R3 is" insert -- an --. |
| Column 22, Line 14 | In Claim 1, delete "NHCO—$R_4$—$NH_2$, $R_3$," and insert -- NHCO—$R_4$—$NH_2$; $R_3$ --, therefor. |
| Column 22, Line 20 | In Claim 1, delete "$C_8H_{17}$," and insert -- $C_8H_{17}$ --, therefor. |
| Column 22, Line 66 | In Claim 11, delete "phenyiheptamethyl" and insert -- phenylheptamethyl --, therefor. |
| Column 24, Line 37 | In Claim 25, after "R3" insert -- is --. |
| Column 24, Line 44 | In Claim 25, delete "$C_8H_{17}$," and insert -- $C_8H_{17}$ --, therefor. |

Signed and Sealed this

Thirteenth Day of May, 2008

JON W. DUDAS
*Director of the United States Patent and Trademark Office*